US006892719B2

(12) United States Patent
Briganti et al.

(10) Patent No.: US 6,892,719 B2
(45) Date of Patent: May 17, 2005

(54) BLADE FOR CUTTING CONCRETE

(75) Inventors: Sam F. Briganti, Riverside, CA (US); George A. Shields, Riverside, CA (US); Rodger D. Lagow, Placentia, CA (US)

(73) Assignee: Soff-Cut International, Inc., Corona, CA (US)

( * ) Notice: Subject to any disclaimer, the term of this patent is extended or adjusted under 35 U.S.C. 154(b) by 2 days.

(21) Appl. No.: 10/120,166

(22) Filed: Apr. 10, 2002

(65) Prior Publication Data

US 2003/0192524 A1 Oct. 16, 2003

(51) Int. Cl.[7] ..... B28D 1/12

(52) U.S. Cl. ..... 125/22; 125/12; 125/15; 125/13.01; 125/22

(58) Field of Search ..... 125/12, 15, 13.01, 125/22

(56) References Cited

U.S. PATENT DOCUMENTS

| | | | | |
|---|---|---|---|---|
| 3,127,887 A | | 4/1964 | Metzger | |
| 3,353,306 A | | 11/1967 | Seymour et al. | |
| 3,491,742 A | | 1/1970 | Weiss | |
| 4,291,667 A | * | 9/1981 | Eichenlaub et al. | 125/15 |
| 4,787,362 A | | 11/1988 | Boucher et al. | |
| 4,930,487 A | | 6/1990 | Younger | |
| 5,184,597 A | | 2/1993 | Chiuminatta et al. | |
| 5,197,453 A | | 3/1993 | Messina | |
| 5,537,987 A | * | 7/1996 | Okawauchi | 125/15 |
| 5,579,754 A | * | 12/1996 | Chiuminatta et al. | 125/13.01 |
| 5,829,423 A | | 11/1998 | Benz | |
| 5,868,125 A | | 2/1999 | Maoujoud | |
| 6,129,077 A | | 10/2000 | Parini | |
| 6,203,416 B1 | | 3/2001 | Mizuno et al. | |
| 6,244,262 B1 | | 6/2001 | Keck | |
| 6,283,845 B1 | | 9/2001 | Fischbacher et al. | |

* cited by examiner

*Primary Examiner*—Joseph J. Hail, III
*Assistant Examiner*—Shantese McDonald
(74) *Attorney, Agent, or Firm*—Stetina Brunda Garred & Brucker

(57) ABSTRACT

A method and apparatus for providing radiused corners on a crack control groove is provided. A radius on the two opposing corners of the crack control groove is simultaneously formed by inserting a pilot segment of a rotating cutting blade into the groove to chase the groove with the blade. The cutting blade has side cutting segments on opposing sides of the pilot segment. The side cutting segments have a concave shape with abrasive material thereon and are located and sized to cut a predetermined radius on the opposing corners 32. Convex shaped shoulder segments inhibit the formation of a well if the blade cuts too deeply. The pilot segment advantageously has no abrasive on its sides so it does not widen the groove, and the pilot segment is shorter than the depth of the groove so it does not deepen the groove.

27 Claims, 6 Drawing Sheets

BLADE FOR CUTTING CONCRETE

FIELD OF THE INVENTION

This invention relates to blades used to cut concrete.

BACKGROUND OF THE INVENTION

As concrete slabs harden the concrete shrinks and cracks form. Grooves are placed in the slabs so that these cracks form along the grooves rather than form randomly throughout the slab. In small concrete surfaces, these grooves are formed by hand operated grooving trowels which push the aggregate in the concrete aside to form the groove and in the process form a thin cement layer on the surface of the groove. The groove may have to be troweled several times in order to maintain the shape of the groove. These grooves have rounded edges and may also have flattened areas by the grooves left from the trowels. These rounded edges are aesthetically pleasing to many people and reflect a hand finished slab of concrete.

On large slabs of concrete, hand troweling of grooves is impractical. The hand troweling of the grooves must be done while the concrete is soft enough for the trowel to push the aggregate aside, and at that stage the concrete is not hard enough support the weight of the person troweling the groove. It is impractical to support people over large slabs of concrete to perform the troweling. Repeatedly troweling the grooves is also expensive, and for large slabs of concrete the costs are further increased.

For large slabs of concrete, the grooves are cut in the concrete by saws using thin, rotating cutting blades that cut through the aggregate. These cuts were historically made the day after the concrete was poured and after the concrete had set enough to walk on it without leaving indentations in the concrete surface. These grooves were formed by large saws using concrete-cutting discs that cut thin grooves in the concrete. More recently the cutting of grooves has been used where the concrete is cut by rotating saw blades at the time of finishing or within a few hours of finishing the concrete surface. This early cutting requires special saws and blades in order to avoid unacceptably damaging the concrete surface, but the earlier cut grooves control cracks better than the prior practice where the concrete is cut the next day. Such systems use the teachings of U.S. Pat. No. 4,769,201.

When the concrete is cut by saws the grooves are typically small in width, about 0.1 inch (2.5mm), and have square corners. The wider the groove, the greater the amount of concrete that has to be removed and that takes a larger saw, takes a longer time, and wears out the expensive cutting blades faster. Further, the wider the groove the greater the likelihood that the square edges on the groove will crack, chip and spall.

These square corners that occur on machine cut grooves lend themselves to cracking or chipping easier than the rounded corners formed by the trowels. The square corners also do not appear as aesthetically pleasing to many people as do the rounded corners. Further, the square corners do not give the appearance of hand finishing as do the troweled corners.

Blades having an inverted T shape have been used to cut sealant wells in concrete, but these grooves have the deficiencies discussed above with the square corners and appearance of a machine cut groove. Some concrete saw blades have opposing sides slanting toward each other to form a V shaped groove are used to place an inclined surface on a previously cut groove. These blades have sharp corners that suffer from the same problems as the square corners, but to a slightly smaller degree.

There remains a need for a fast, economical way to provide concrete surfaces, especially large concrete surfaces, with grooves that appear to have been formed by hand trowels.

BRIEF SUMMARY OF THE INVENTION

[Type in brief summary]

BRIEF DESCRIPTION OF THE DRAWINGS

These as well as other features of the present invention will become more apparent upon reference to the drawings in which like numbers refer to like parts throughout, and wherein:

FIG. 2*b* shows an enlarged portion taken along section 2*b*—2*b* of FIG. 2*a;*

DETAILED DESCRIPTION

Figure 1:
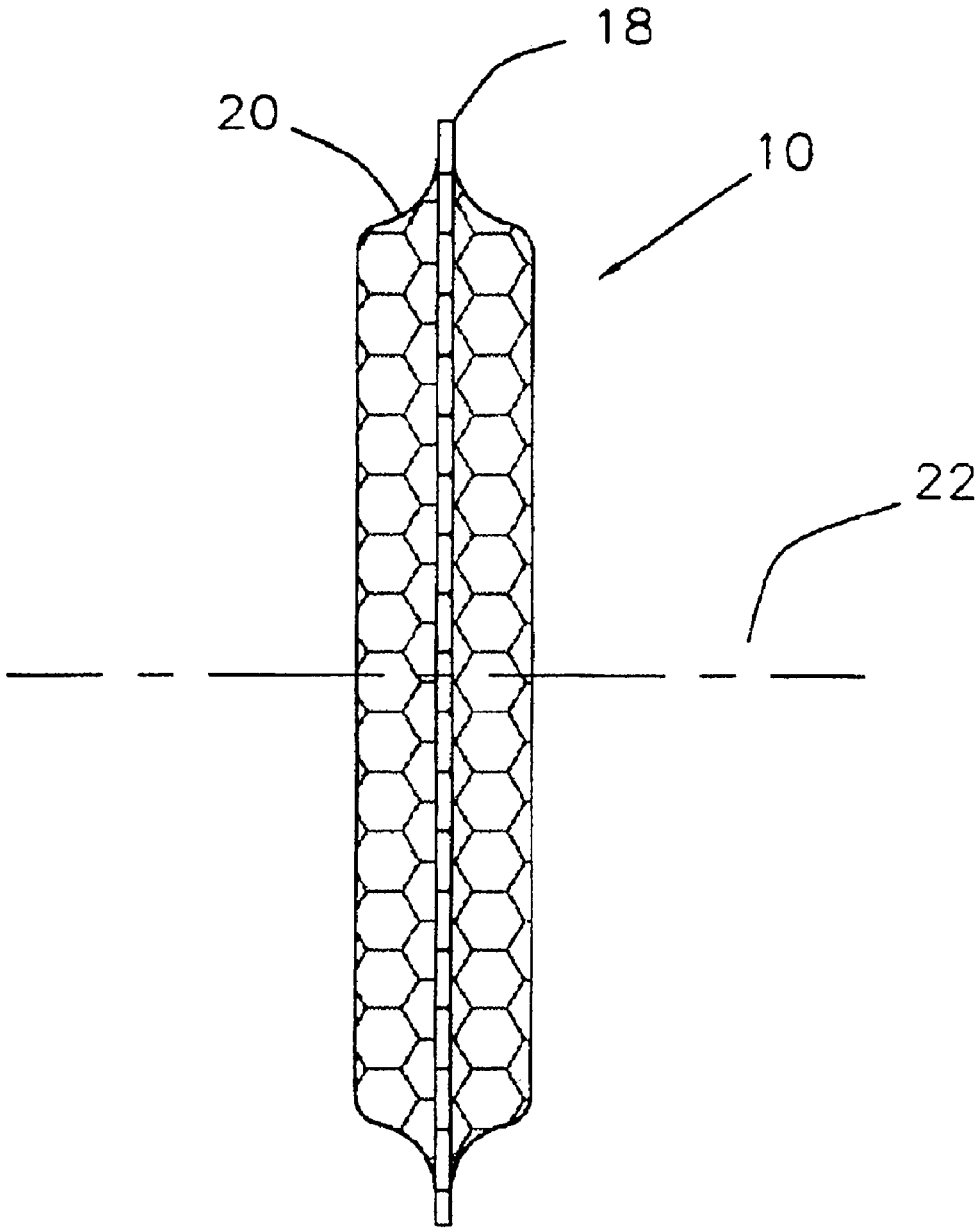
FIG. 1 shows an end view of a concrete cutting blade of this invention.
Figure 2A:
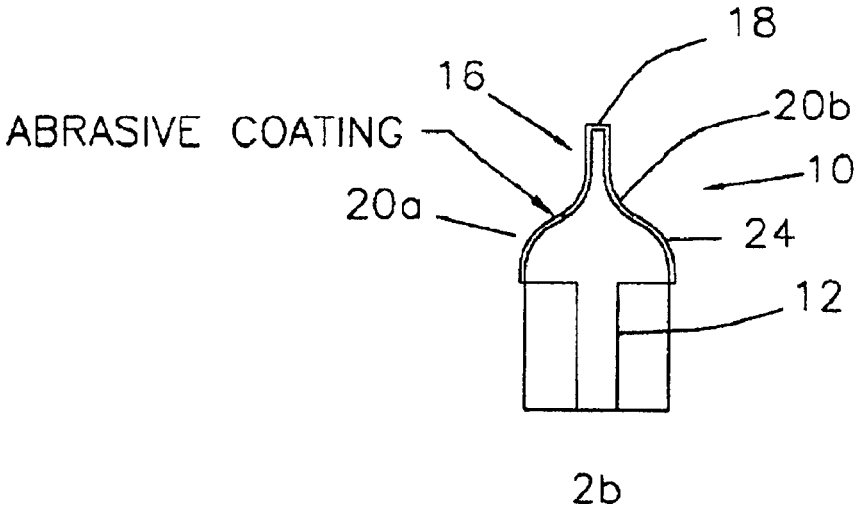
FIG. 2*a* shows a cross-section of the blade of FIG. 1.
Figure 2A:
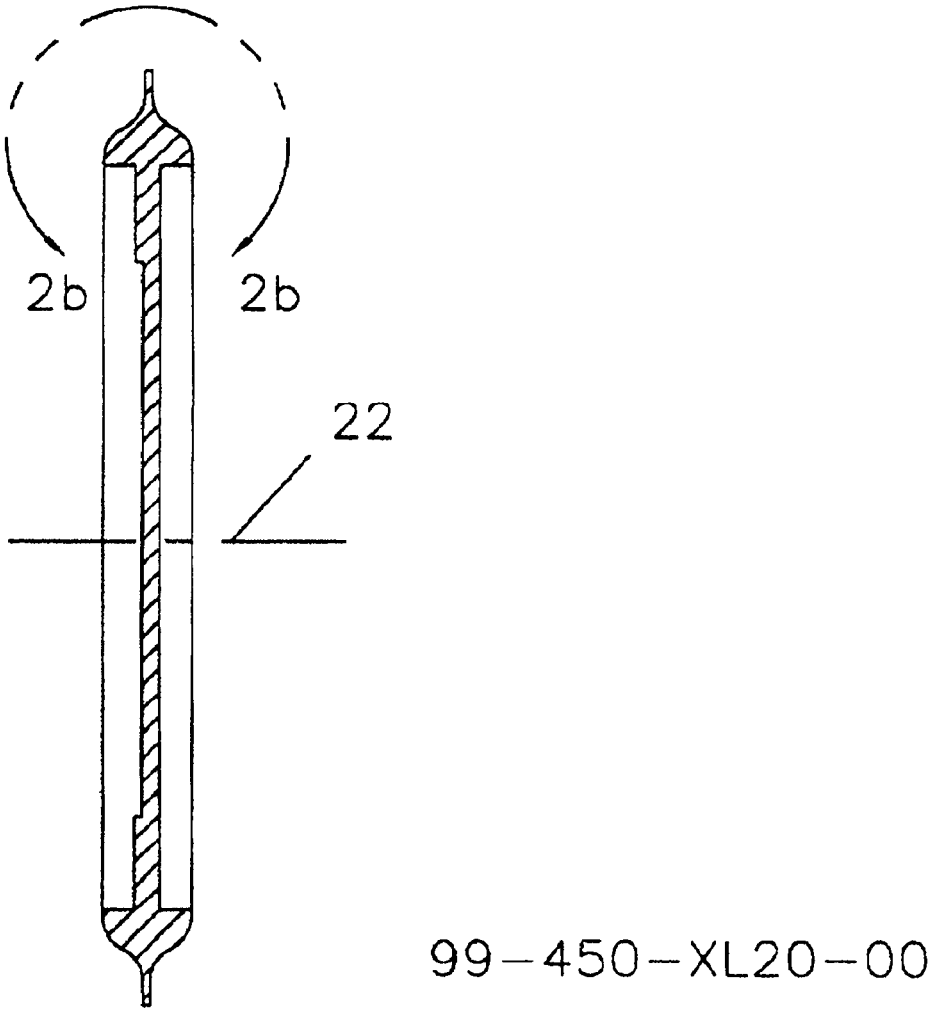
Figure 3:
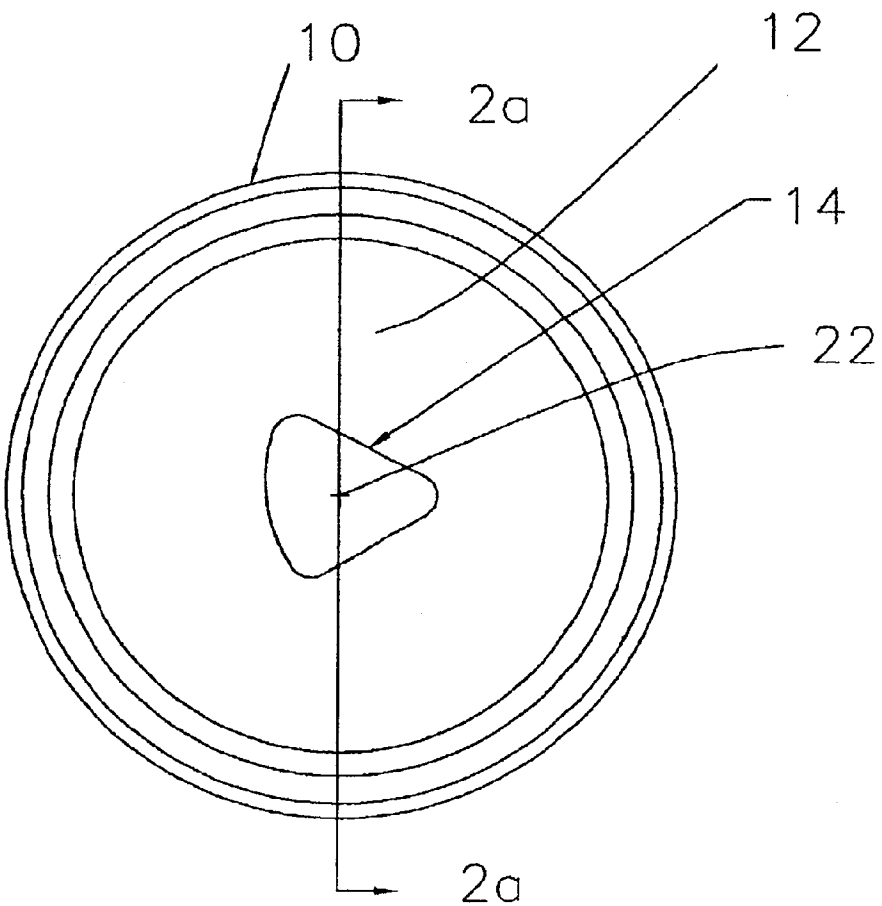
FIG. 3 is a side view of the blade of FIG. 1.

Referring to FIGS. 1–3, a concrete cutting blade 10 has disc 12 with a hole 14 therein for mounting to a drive shaft of a motor (not shown) on a concrete cutting saw. The saw can have wheels, a skid plate, or both. The disc rotates about the longitudinal axis of the drive shaft which extends through the hole 14. The blade 10 has a cutting segment 16 that has a central, pilot segment 18 in the middle of two side cutting segments 20*a*, 20*b*, which are mirror images of each other.

Referring to FIG. 2*b*, the cutting segment 16 is described in more detail. The central or pilot segment 18 extends radially away from the rotational axis 22 (FIG. 2*a*) about which disc 10 rotates. As used herein, the radial direction is orthogonal to the rotational axis 22. The side segments 20 have a concave portion that tangentially joins the pilot segment 18. The concave portion is preferably, but optionally a radiused portion having a radius between about ⅛ to ½ inch (about 4–13 mm), and more preferably between about ¼ and ⅜ inches (about 6–10 mm), and ideally about ¼ inches (about 6 mm) in radius. Larger radii could be used, but are not as desirable. Advantageously, the side cutting segments 16 extend along the rotational axis a distance corresponding to the radius of the concave portion. This axil distance is greater than the width of the pilot segment 18 measured along the rotational axis.

The side segments 20 extend axially, parallel to the rotational axis 22 a predetermined distance. As used herein, the axial direction is parallel to the rotational axis 22. Preferably, but optionally, the side segments 20 have a convex shoulder 24 that the curves toward the rotational axis 22. Preferably, but optionally, the radiused juncture between the pilot segment 18 and the side segments 22 is tangential to the pilot segment 18 and tangential to the shoulder 24. Advantageously, the shoulder 24 is radiused, with a radius about half that of the concave radius 22 joining the pilot segment to the shoulder 24, but curving in the opposite direction. For a blade 10 having a diameter of about 5 inches (about 180 mm) the cutting segment 16 is about ⅝ inches (about 16 mm) wide measured along the rotational axis 22.

The shoulder 24 begins where the radiused corner of the side segments 22 change curvature from a concave, interior corner, and begin to form a convex, exterior corner or shoulder. During use, the shoulder 24 is not intended to cut into the concrete for any appreciable distance or depth, and thus preferably does not extend for any appreciable distance radially toward the longitudinal or rotational axis 22. A shoulder 24 extending for about ⅛ to ¼ inch (about 4–7 mm) along the radial direction is believed suitable.

Figure 5B:
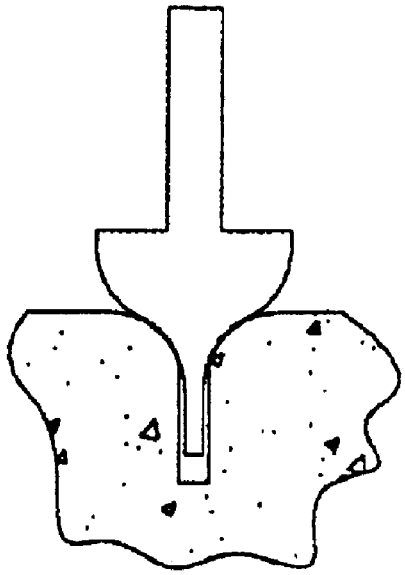
FIGS. 5*a*, 5*b* show a cross section of a groove before and after being cut by the blade of FIG. 1, respectively.
Figure 5A:
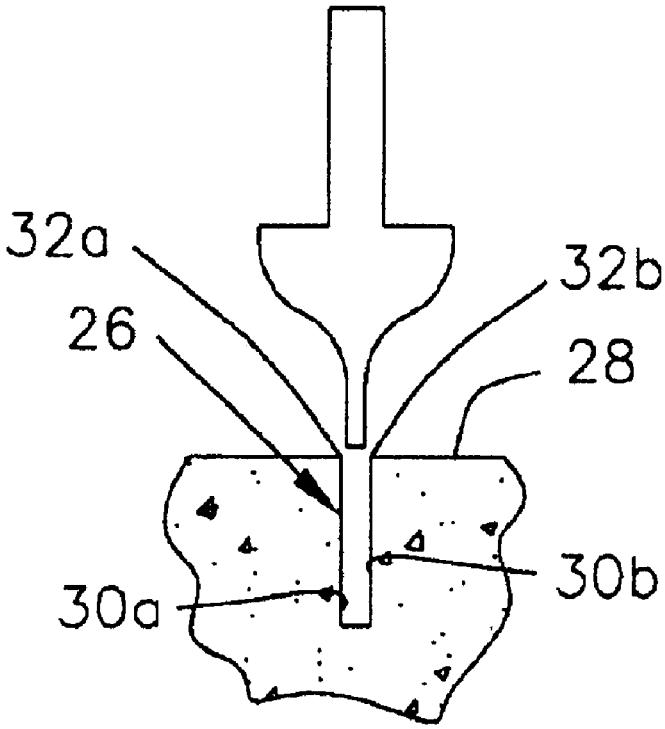

Referring to FIG. 5*a*, the blade 10 is used with a groove 26 previously cut in to a concrete surface 28. The groove 26 has opposing sides 30*a*, 30*b* that form opposing corners 32*a*, 32*b* where the groove opens onto the surface 28 of the concrete. These corners are sharp, and can break, chip or crack. The grooves 26 are typically narrow, about 0.1 inches (2.5 mm) and the depth will vary according to the thickness of the concrete and whether the concrete is cut the day after being poured, or cut at the time of finishing or shortly thereafter. Typically the grooves 26 are about ¼–⅓ the thickness of the concrete for grooves cut the day after pouring, and are from about ½ (13 mm) to 3 inches (76 mm) deep (but less than ⅓ the thickness of the concrete) for grooves cut at a time of finishing or shortly thereafter.

The blade 10 cuts a radius on these corners 32, with the radius of curvature preferably being selected to make the corners have the shape of hand troweled corners. The radius is from about ⅛ to ½ inch (about 3 to 13 mm), and preferably from ¼ to ⅜ inch (about 6 to 9 mm), and ideally about ¼ inch (6 mm). Larger radii can be used, but they are less desirable.

Forming this radius on the corners 32 is achieved by placing the pilot segment 18 of blade 10 in groove 26 so the pilot guides the blade along the groove. The side cutting segments 20 are urged toward the exterior surface of the concrete 28 so that a radiused corner is formed. That gives the rounded appearance many people find pleasing and desirable. Advantageously the blade 10 forms a radiused corner that is tangential with the exterior surface of the concrete 28, but that need not be the case. The radius preferably extends around a sufficient portion of the corner 32 so that the sharp edge is broken and the corner is less likely to chip, crack and break off. The blade 10 is preferably not urged against the concrete surface 28 sufficiently that the lateral edges of the side segments 20 or the shoulder 24 cut into the exterior concrete surface 28. That would form an indentation or well in the concrete surface 28 that is likely to be undesirable. The curved shoulders 24 help avoid a sharp corner in the event that the side cutting surfaces 20 cut too deeply into the concrete surface 28.

As the side cutting segments 20 cut the corners 32, they cut through and expose the aggregate in the concrete. The exposed aggregate gives a different appearance than that of a hand troweled groove because the hand troweling covers the aggregate with a thin layer of cement. The exposed aggregate is believed to be more pleasing and desirable. The larger radius corners expose more aggregate and are thus believed more desirable than the corners with smaller radii.

The blade 10 is preferably used to cut the concrete after the concrete is hardened. Next-day cutting is preferred as the concrete corners 32 are sufficiently hard that cutting with the blade 10 will not unacceptably damage the concrete surface 28. No skid plate need be used to support the concrete surface within a very small distance of the cutting blade as is the case with the teachings of U.S. Pat. No. 5,184,597. Water may be used to lubricate the cutting, or dry cutting blades can be used. For early-entry systems that cut at the finishing of the concrete or shortly after the finishing, the use of the blade 10 is preferably slightly delayed from the time the groove 26 is cut. Advantageously, the concrete 28 is not cut until the concrete has a hardness of about 800 psi in a compressive strength test, which corresponds to the final set of the concrete. This is toward the end of the window in which the wet-cutting systems can cut concrete. Preferably, though, the cutting occurs the next-day, after pouring and finishing. On a hot, dry day, the cutting can occur toward the end of the same day as the concrete will set faster with the increased temperature and low humidity.

The disc 12 is made of metal, preferably a steel suitable for cutting blades. The cutting segments 16 are made of suitable abrasive material for cutting concrete, or made of metal coated with a suitable abrasive. The cutting segment could be made integrally and entirely of abrasive material, or it could be made of metal coated with abrasive material. The cutting segments 16 may extend continuously around the periphery of the blade 10, or they may be segmented into any desirable number of cutting segments. Further, the pilot segment 16 can be continuous while the side segments 20 and shoulders 24 are segmented.

Figure 4:
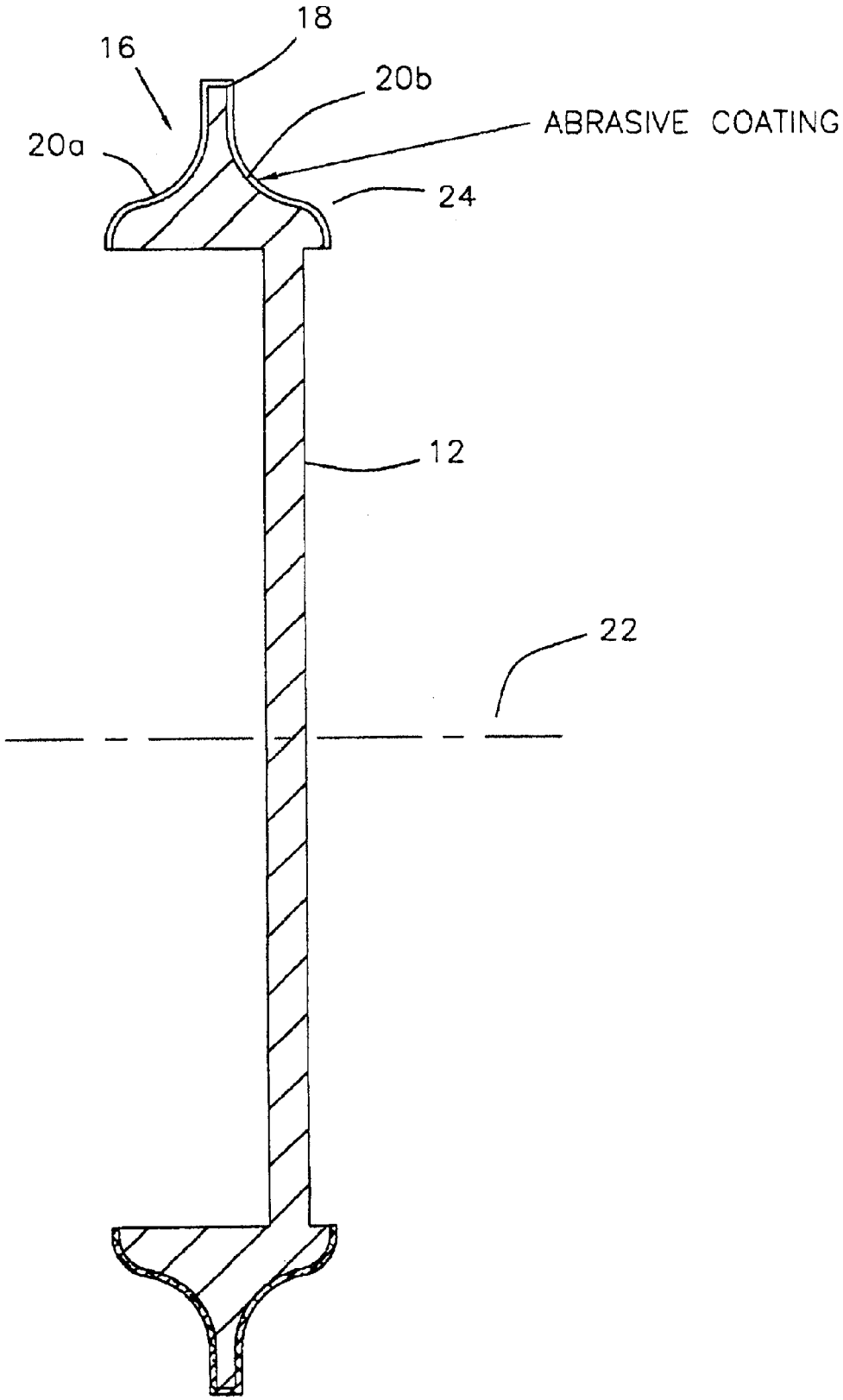
FIG. 4 shows a cross section of a further embodiment of the blade of FIG. 1.

As seen in FIG. 4, the disc 12 and cutting segment 16 is integrally formed into a single piece of material, such as steel. Molding, casting, machining or welding parts together can produce such an integral blade 10. An abrasive coating is placed on the exterior portion of the cutting segment 16. A coating of diamond, carbide, oxidized aluminum and ground industrial diamonds, or by cutting surface materials yet to be developed. Preferably suitable abrasive particles are electroplated onto the desired portions of the cutting segment 16. A thickness of about 0.02 inches of diamond abrasive is believed suitable. Various grit and material combinations are usable depending on power, material cut, and desired surface finish. A suitable electroplate coating is believed to be DeBeers SDA-25, which is believed to have 25% of 30–40 mesh, 50% of 40–50 mesh, and 25% of 60–80 mesh diamond.

The opposing sides of the pilot segment 18 may be coated with abrasive cutting material, or optionally, may have no cutting material on them. If cutting material is provided on the sides of the pilot segment 18, it may widen the groove slightly, and may widen the groove unevenly causing an undesirable appearance.

The pilot segment 18 is used to guide the blade 10. It is desirable to have the radial periphery of the segment 18 coated with abrasive material so that it can clean the groove 26 of debris. But the radial length of the pilot segment 18 is preferably shorter than the depth of the groove 26 so that the blade 10 does not increase the depth of the groove 26. Indeed, the longer the pilot segment 18, the more power is required to rotate the blade 10 and it is desirable to use as little power as possible. Thus, the radial length of the pilot segment 18 is preferably selected so that it does not contact the bottom of the groove 26 internal to the concrete. The pilot segment preferably has a radial length of about ¼–⅜ inch (about 8–10 mm) above the lateral or axially extending portion of the side segments 20 and above the shoulder 24. This distance is believed suitable for blades 10 with diameters of about six inches or less. For larger diameter blades 10, the radial length of the pilot segment 18 can extend up to about ½ inch (13 mm). Longer pilot segments 18 can be used, but they are less preferable. A radial length of about 0.4 inches (about 10 mm) is believed suitable for a blade 10 having a diameter of about 5 inches (150 mm) Because the pilot segment 18 determines the maximum diameter of the blade 10, the blades used for cutting the radiused corners are generally smaller in diameter than the corresponding blades used to cut the crack control grooves 26.

Further, the pilot segment 18 is preferably not intended to widen the previously cut groove, and is not intended to form the groove in the first place. The blade 10 can have a slight wobble or misalignment during use and that can cause the abrasive coating on the sides of the pilot segment 18 to contact and abrade the sides 30 of the groove 26 during cutting and that will slightly enlarge the groove 26 and require more power from the motor rotating the saw blade 10. But the width of the groove 26 is not substantially changed after the blade 10 cuts the radiused corners on the groove. As used here, no substantial change in the width of the groove means an increase of about 10% of the width or less, and preferably less than about 5% and ideally no change at all.

Thus, the pilot segment 18 is preferably smaller along the axial direction than the width of the groove 26, but still wide enough to perform its guiding function. As the groove 26 is typically cut by blades about 0.1 inch thick (2.5 cm) the pilot segment 18 is preferably smaller. A width of about 0.06 inches (about 1.5 mm) is believed suitable for grooves 26 cut with a 0.09 inch (2.3 mm) wide blade. Thus, the width of the pilot portion 18 is about ⅔ the width of the groove 26. Larger diameter cutting blades may be thicker, with 0.125 inch (3.2 mm) wide grooves 26 being one common size. For these wider grooves, pilot segments 18 having a width of about 0.05 to 0.075 inches (about 1.3 to 1.9 mm) are believed suitable. For grooves 26 cut by crack control blades the pilot segment can be sized according to the larger width of the grooves 26. For general guidance, the width of pilot 18 measured along the rotational axis 22 is preferably about 0.6 times the width of the groove 26. Advantageously, but less desirably, the width of the pilot 18 is from 0.4 to 0.8 times the width of the groove 26, and more advantageously from about 0.6 to 0.8 times the width of the groove 26. Preferably the pilot 18 is less than 0.8 times the width of the groove 26. It is possible, but not desirable, that the pilot segment 18 can cut the groove 26 to slightly widen it, or to ensure the groove has a minimal depth. But this is not preferred.

Figure 6:
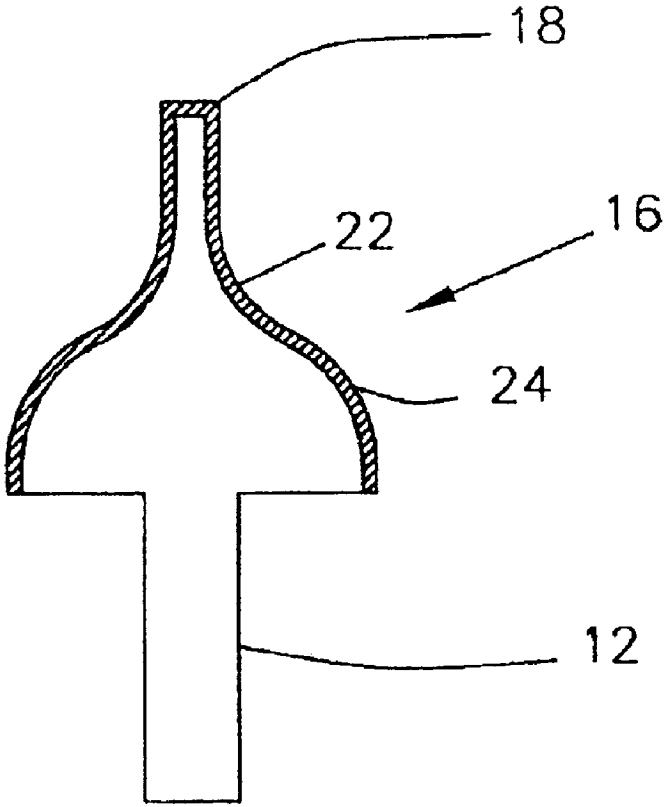
FIG. 6 is a cross sectional view of a further embodiment of the cutting segment of the blade of FIG. 1.

The side cutting segments 20 thus have a first end that joins the pilot segment 18 at a location which has a width less than the width of the groove 26 to be cut. Preferably the juncture of the first end of the side cutting segments 20 and the pilot segment 18 is tangential. A stepped juncture could also be used but preferably a juncture that avoids forming sharp corners in the cut concrete, are avoided. The side cutting segments have a second end that joins shoulder segment 24. The shoulder segment 24 is preferably a convexly curved portion and the juncture is tangential as shown in FIGS. 2*b* and 4. But the shoulder 24 could be a right angle shoulder as shown in FIG. 6. The radial side of the shoulder 24 could be coated with abrasive material, or it could be the base material from which the cutting segment 16 is made. Because the cutting segment could be made integrally and entirely of abrasive material, or it could be made of metal coated with abrasive material, the radial portion of the shoulder 24 in FIG. 6 could thus be abrasive, or non-abrasive relative to the concrete groove 26. FIG. 6 shows a layer of abrasive material on the pilot segment 18 and side segments 20, but not on the shoulder segments 24.

A further embodiment of the blade 10 is shown in FIG. 4, which shows the disc 12 axially offset from the centrally located pilot segment 18. The prior embodiment as best seen in FIG. 2*a* had the disc 12 in the same plane as the central, pilot segment 18. The embodiment shown in FIG. 4 has the disc 12 axially offset so it rests in the plane of the juncture of the shoulder 24 and the curved side cutting segment 20*b*. The disc 12 is offset from the center of the cutting segment 16. This offset is about 7/16 inch (about 11 mm) from the distant edge of the shoulder 20*a*, and about ⅜ inches (about 10 mm) from the center of the cutting segment 16.

The offset allows the cutting segment to be mounted on some saws that otherwise do not have enough room to accommodate the wide cutting segment 16 or that have slots in base plates that require alignment with the blade. These concrete saws typically have a base plate on which the motor is mounted, and a slot in the baseplate allows the blade to pass through the slot to the concrete. Depending on the particular saw used and the location of the blade mounting arbor relative to the slot, the offset may be needed to center the blade in the slot. This offset has been used before on prior art saw and blades.

The use of the cutting blade avoids the labor and difficulties of repeated troweling needed to achieve the radiused corners using hand trowels. The use of the pilot segment to follow a previously cut groove achieves a straighter and more uniform groove than is achieved by hand troweling.

There is thus advantageously provided a method of providing radiused corners 32 on crack control grooves 26 previously cut in a concrete surface 28. The pilot segment 18 provides a means for guiding the blade along previously cut grooves 26. The side cutting segments 20 provide means for providing a radius to the corners 32 of the previously cut groove 26. The shoulders 24 provide means for reducing the formation of a well or secondary groove along the previously cut groove 26 and for providing a gradual juncture between the radiused corner and the exterior surface of the concrete 28 and the radiused groove.

There is also advantageously provided a method of cutting radiused grooves on the edges of crack control groves. A concrete slab is finished. Crack control grooves 26 are cut in the slab using a first rotating blade. The grooves 26 are cut at the time of finishing or shortly thereafter, or cut the next day. The grooves 26 have opposing side walls 30 having a first depth and a first width with two corners 32 joining the two opposing side walls to the exterior surface of the concrete along opposing edges of the groove. Thereafter, a radius on the two opposing corners 32 is simultaneously formed by inserting a pilot segment 18 of a second cutting blade 10 into the groove to chase the groove with the blade. The cutting blade has side cutting segments 20 on opposing sides of the pilot segment. The side cutting segments 20 have a concave shape with abrasive material thereon and are located and sized to cut a predetermined radius on the opposing corners 32.

Preferably, but optionally, the pilot segment 18 has a width along a rotational axis of the blade that is smaller than the first width of the groove 26, and that extends above the side cutting segments 20 a distance less than the first depth so that the groove has substantially the same depth and width before and after the corners are cut. The concrete surface formed by this method is believed to be different than previously known. Cutting through the aggregate in the concrete to form the corners forms a different appearing radiused edge on the groove.

The above description is given by way of example, and not limitation. Given the above disclosure, one skilled in the art could devise variations that are within the scope and spirit of the invention, including various ways of mounting the cutting segments 16 on discs 12. Further, the various features of this invention can be used alone, or in varying combinations with each other and are not intended to be limited to the specific combination described herein. Thus, the invention is not to be limited by the illustrated embodiments but is to be defined by the following claims when read in the broadest reasonable manner to preserve the validity of the claims

What is claimed is:

1. A concrete cutting blade having a disc with a mounting hole therein to rotate about a longitudinal axis through the hole, and having a cutting surface on a periphery of the disc, the improvement comprising an integral cutting blade having a cutting surface having a central pilot portion extending radially and having two opposing sides separated by a radial edge having an axial width with cutting material thereon, a concave, radiused cutting surface joining each side and having a radius of about ⅛ to ½ inch and extending from at least one of the sides a distance greater than the axial width of the radial edge.

2. The cutting blade of claim 1, wherein the radiused cutting surface is tangential to the sides of the pilot portion.

3. The cutting blade of claim 2, wherein each of the radiused cutting surfaces extend from the sides a distance at least about twice the width of the radial edge.

4. The cutting blade of claim 1, wherein the radius is about ¼ to ⅜ inch.

5. The cutting blade of claim 1, wherein the radius is about ¼ inch.

6. The cutting blade of claim 1, wherein the pilot extends at least about ¼ inch radially from the radiused cutting surface.

7. The cutting blade of claim 1, wherein the width of the radial edge on the pilot is selected to be smaller than a width of a groove in concrete that the blade is going to cut.

8. The cutting blade of claim 1, wherein the opposing sides of the pilot segment are generally parallel and have no cutting material thereon.

9. The cutting blade of claim 1, wherein the opposing sides are generally parallel and have cutting material thereon.

10. The cutting blade of claim 1, wherein the disc is in the same plane as the central pilot.

11. The cutting blade of claim 1, wherein disc is in a plane, parallel to but axially offset from the central pilot.

12. The cutting blade of claim 1, wherein each cutting segment further comprises a convex shoulder extending toward the longitudinal axis.

13. The cutting blade of claim 1, wherein the pilot has a radial length selected so that it does not contact the bottom of a groove into which the pilot segment is inserted during use of the blade.

14. The concrete cutting blade of claim 1, wherein the cutting surfaces comprise electro-plated abrasives.

15. A concrete cutting blade comprising:

a disc having a mounting hole therein for mounting the disc to a motor to rotate the disc about a rotational axis extending through he hole;

non-cutting pilot means on a periphery of the disc for being inserted into a groove and following the groove without cutting and substantially widening the groove or increasing a depth of the groove during use of the blade;

cutting means on opposing sides of the pilot means for cutting radiused corners on opposing edges of the groove during use of the blade, the cutting means being formed integrally with the pilot means.

16. The cutting blade of claim 15, wherein the pilot means has an axial width selected to be less than the groove into which the blade is inserted during use of the blade, and wherein the pilot means has a radial length relative to the side cutting means selected to be less than a depth of the groove into which the pilot means is inserted during use of the blade.

17. The concrete cutting blade of claim 15 wherein the cutting surfaces comprise electro-plated abrasives.

18. A concrete cutting blade comprising:

a disc having a mounting hole therein for mounting the disc to a motor to rotate the disc about a rotational axis extending through he hole;

cutting pilot means on a periphery of the disc for being inserted into a groove and following the groove without substantially widening the groove during use of the blade;

cutting means on opposing sides of the pilot means for cutting radiused corners on opposing edges of the groove during use of the blade, the cutting means being formed integrally with the pilot means, wherein the pilot means has sides which have no cutting material thereon.

19. A concrete cutting blade comprising:

a disc having a mounting hole therein for mounting the disc to a motor to rotate the disc about a rotational axis extending through he hole;

cutting pilot means on a periphery of the disc for being inserted into a groove and following the groove without substantially widening the groove during use of the blade;

cutting means on opposing sides of the pilot means for cutting radiused corners on opposing edges of the groove during use of the blade, the cutting means being formed integrally with the pilot means; and shoulder means for reducing the formation of a well in the concrete during use of the blade.

20. A concrete cutting blade comprising:

a disc having a mounting hole therein for mounting the disc to a motor to rotate the disc about a rotational axis extending through he hole;

cutting pilot means on a periphery of the disc for being inserted into a groove and following the groove without substantially widening the groove during use of the blade;

cutting means on opposing sides of the pilot means for cutting radiused corners on opposing edges of the groove during use of the blade, the cutting means being formed integrally with the pilot means, wherein the cutting means have a radius of about ¼–⅜ inch and extend from the pilot means a distance parallel to the rotational axis that is greater than a width of the pilot means measured parallel to the rotational axis.

21. A method of cutting grooves in an exterior surface of concrete, comprising the steps of:

finishing a concrete slab;

cutting crack control grooves in the slab using a first rotating blade, the grooves having opposing side walls having a first depth and a first width with two corners joining the two opposing side walls to the exterior surface of the concrete along opposing edges of the groove;

thereafter simultaneously forming a radius on the two opposing corners by inserting a pilot segment of a second cutting blade into the groove, the cutting blade having side cutting segments on opposing sides of the pilot segment, the side cutting segments having a concave shape with abrasive material thereon and being located to cut a radius on the opposing corners.

22. The method of claim 21, wherein the pilot segment has a width along a rotational axis of the blade that is smaller than the first width of the groove and extending above the side cutting segments a distance less than the first depth so that the groove has substantially the same depth and width before and after the corners are cut.

23. The method of claim 21, wherein the radius on the two opposing corners is about ¼–⅜ inch.

24. The method of claim 21, wherein the radius on the two opposing corners is from about ⅛ to ½ inch.

25. The method of claim 21, wherein the crack control groove has substantially the same width before and after the radiused corners are cut.

26. The method of claim 21, further comprising following the crack control groove with the pilot segment without substantially widening the crack control groove.

27. the method of claim 21, further comprising selecting the pilot segment to extend into the crack control groove to a depth that is less than the depth of the crack control groove, while the radiuses are formed on the two opposing corners.

* * * * *